US008858123B2

(12) United States Patent
Schmit et al.

(10) Patent No.: US 8,858,123 B2
(45) Date of Patent: Oct. 14, 2014

(54) INJECTION SYSTEM FOR SOLID PARTICLES

(75) Inventors: Jean Schmit, Diekirch (LU); Bernard Cauwenberghs, Holzem (LU); Guy Junk, Ettelbruck (LU); Claude Junk, legal representative, Vianden (LU); Benoît Junk, legal representative, Ettelbruck (LU); Christian Lunkes, Soleuvre (LU)

(73) Assignee: Paul Wurth S.A., Luxembourg (LU)

( * ) Notice: Subject to any disclaimer, the term of this patent is extended or adjusted under 35 U.S.C. 154(b) by 1186 days.

(21) Appl. No.: 12/742,816

(22) PCT Filed: Nov. 14, 2008

(86) PCT No.: PCT/EP2008/065533

§ 371 (c)(1),
(2), (4) Date: May 31, 2011

(87) PCT Pub. No.: WO2009/063037

PCT Pub. Date: May 22, 2009

(65) Prior Publication Data

US 2011/0232547 A1 Sep. 29, 2011

(30) Foreign Application Priority Data

Nov. 16, 2007 (LU) ..... 91376

(51) Int. Cl.
*B65G 53/66* (2006.01)
*F23K 3/02* (2006.01)

(52) U.S. Cl.
CPC ..... *F23K 3/02* (2013.01); *F23K 2203/006* (2013.01); *F23K 2203/201* (2013.01)
USPC ..... 406/24; 406/123; 406/136; 110/105; 110/263

(58) Field of Classification Search
CPC ..... F23K 3/02; F23K 2203/008
USPC ..... 406/23, 24, 123, 136, 137, 138; 110/105, 263, 288; 222/55, 195
See application file for complete search history.

(56) References Cited

U.S. PATENT DOCUMENTS 4,368,678 A * 1/1983 Ulveling ..... 110/347
4,702,182 A 10/1987 Ulveing et al.

(Continued)

OTHER PUBLICATIONS

International Search Report; PCT/EP2008/065533; Mar. 31, 2009.

*Primary Examiner* — Joseph Dillon, Jr.
(74) *Attorney, Agent, or Firm* — Cantor Colburn LLP

(57) ABSTRACT

An injection system for solid particles comprises a conveying hopper (11) located at an upstream location (1), a fluidizing device (21) for fluidizing the solid particles at the outlet of the conveying hopper (11) and forming a solid-gas flow, a pneumatic conveying line (15) for conveying the solid-gas flow from the fluidizing device (21) to a downstream location (2) and a static distribution device (17) with a plurality of injection lines (19), connected thereto. An upstream flow control system controls the mass flow rate in the pneumatic conveying line (15) at the upstream location (1) by controlling the opening of an upstream flow control valve (35) responsive to the solid material mass flow measured in the pneumatic conveying line (15) at the upstream location (1). A downstream flow control system controls the mass flow rate in the pneumatic conveying line (15) at the downstream location (2) by controlling the opening of a downstream flow control valve (51, 79*i*) responsive to the instantaneous mass flow rate sensed by a main downstream mass flow rate sensor (53).

16 Claims, 4 Drawing Sheets

(56) References Cited

U.S. PATENT DOCUMENTS

| | | | | |
|---|---|---|---|---|
| 4,758,118 | A * | 7/1988 | Rachner et al. | 406/24 |
| 5,048,761 | A * | 9/1991 | Kim | 241/19 |
| 5,123,632 | A | 6/1992 | Schmit et al. | |
| 5,285,735 | A | 2/1994 | Motoi et al. | |
| 5,378,089 | A * | 1/1995 | Law | 406/123 |
| 6,749,373 | B2 * | 6/2004 | Von Geldern et al. | 406/23 |
| 7,607,398 | B2 * | 10/2009 | Tietze et al. | 110/347 |
| 7,878,737 | B2 * | 2/2011 | Naunheimer | 406/192 |
| 8,348,556 | B2 * | 1/2013 | Hilgraf et al. | 406/123 |
| 8,601,957 | B2 * | 12/2013 | Conrads et al. | 110/188 |
| 2007/0074643 | A1 | 4/2007 | Tietze et al. | |
| 2010/0316472 | A1 * | 12/2010 | Hilgraf et al. | 414/296 |
| 2012/0266966 | A1 * | 10/2012 | Kretschmer et al. | 137/1 |
| 2012/0325129 | A1 * | 12/2012 | Frisch et al. | 110/188 |

* cited by examiner 11
41
21
25
31
23
27
29
33
FT
SP
PV
PT
69
71
78
39
41
73
75
77
37
FC
SP
45
47
49
35
PT
D
1
2
53
55
63
81
PV
FC
SP
59
57
X
86
85
67
87₁
89₁
79₁
19₁
17
13₁

INJECTION SYSTEM FOR SOLID PARTICLES

TECHNICAL FIELD

The disclosure generally relates to the injection of solid particles and, in particular, to the injection of pulverized coal into a blast furnace.

BACKGROUND

In the art of blast furnace operation it is well known to reduce the consumption of coke by injecting pulverized coal into the hot blast in the blast furnace tuyeres. Such an injection system typically comprises a conveying hopper located at a first location, generally in proximity of a pulverized coal preparation plant, a fluidizing device for fluidizing the pulverized coal at the outlet of the conveying hopper and a pneumatic conveying line connecting the fluidizing device to a distribution device located at a second location, generally in proximity of the blast furnace. In the distribution device, the pneumatic flow is split between several injection lines, which are connected to injection lances arranged in the blast furnace tuyeres for injecting the pulverized in to the hot blast. It will be noted that the distance between the first location (also called upstream location hereinafter) and the second location (also called downstream location hereinafter) generally equals several hundred meters and often exceeds 1 km.

In order to warrant constant process conditions in the blast furnace, the quantities of pulverized coal injected into the blast furnace must be precisely adjustable and should not be subjected to major fluctuations. Different methods for mass flow rate control in such injection systems have been developed so far. According to a first method, the mass flow rate is controlled by adjusting the gas pressure in the conveying hopper either responsive to the output signal of a differential weighing system equipping the hopper or responsive to the output signal of a mass flow rate sensor mounted directly in the pneumatic conveying line. According to a second method, the mass flow rate is controlled by adjusting the flow rate of the fluidizing gas injected into the fluidizing device of the conveying hopper or the flow rate of dilution gas injected into the pneumatic conveying line either responsive to the output signal of a differential weighing system equipping the conveying hopper or responsive to the output signal of a mass flow rate sensor mounted directly in the pneumatic conveying line. According to a third method, the mass flow rate is controlled by throttling the pneumatic flow by means of flow control valve. According to a first embodiment of this third method, a main flow control valve is mounted in the conveying line at the conveying hopper location, i.e. in the start section of the pneumatic conveying line, and controlled responsive to the output signal of a differential weighing system equipping the conveying hopper or responsive to the output signal of a mass flow rate sensor mounted in the conveying line at the conveying hopper location. According to a second embodiment of this third method, an injection flow control valve is mounted in each of the injection lines at the distributor location and controlled responsive to the output signal of an injection mass flow rate sensor mounted in the respective injection line.

U.S. Pat. No. 5,123,632 discloses a pneumatic injection system for injecting pulverized coal into a blast furnace. The system comprises two conveying hoppers located at an upstream location. The total flow rate of the pulverized coal to be injected into the furnace is regulated in a metering apparatus at the outlet of each conveying hopper. This metering apparatus is connected by a main pneumatic conveying line to a static distribution device, which is located at a downstream location near the blast furnace and which is e.g. of the type described in U.S. Pat. No. 4,702,182. In this distributor, the primary pneumatic current is split into secondary currents which are conveyed through injection lines to the blast furnace tuyeres. Each injection pipe comprises a closing valve and at least one flow rate control tuyere. It is proposed to maintain in each injection line a constant pressure downstream of the first flow rate control tuyere, either by a pressure controlled injection of a compensating gas or by a pressure controlled valve in the injection line downstream of the first flow rate control tuyere.

U.S. Pat. No. 5,285,735 discloses a system for controlling the injection quantity of pulverized coal from a pressurized feed tank into a pneumatic conveying line, which conveys the pulverized coal to a blast furnace. This document suggests to install a powder flow meter in the conveying line near the pressurized feed tank to measure the flow rate of the pulverized coal flowing into the pneumatic conveying line. The output signal of this powder flow meter is used by a so called flow indicating controller to control the opening of a powder valve installed between the feed tank and the pneumatic conveying line. Alternatively, the flow indicating controller may use the output signal from a weighing system equipping the pressurized feed tank for controlling the opening of the powder valve.

Recent tests carried out by the Applicant of the present application have shown that—despite state of the art mass flow rate control—the mass flow rate in the conveying line and the injection lines is surprisingly subjected to important fluctuations. Applicant has found out that these fluctuations in mass flow rate are the more important the longer the pneumatic conveying line is.

BRIEF SUMMARY

The disclosure seeks to reduce fluctuations in mass flow rate observed in particular with a long pneumatic conveying line interconnecting a conveying hopper at an upstream location and a distribution device at a downstream location.

An injection system for solid particles in accordance with the present invention comprises, in a manner known per se: a conveying hopper located at an upstream location, a fluidizing device for fluidizing the solid particles at the outlet of the conveying hopper and forming a solid-gas flow, a pneumatic conveying line for conveying said solid-gas flow from said fluidizing device to a downstream location, generally at several hundred meters from said upstream location, the pneumatic conveying line including at the downstream location a static distribution device with a plurality of injection lines connected thereto, and an upstream flow control system. This upstream flow control system includes, in a manner known per se: an upstream flow control valve arranged in the pneumatic conveying line at the upstream location and an upstream mass flow rate determination means capable of measuring a solid material mass flow in the pneumatic conveying line at the upstream location. This upstream flow control system controls the mass flow rate in the pneumatic conveying line at the upstream location by controlling the opening of the upstream flow control valve responsive to the solid material mass flow measured in the pneumatic conveying line at the upstream location. In accordance with an important aspect of the present invention, the injection system further comprises a downstream flow control system including: at least one downstream flow control valve arranged in the pneumatic conveying line at the downstream location and a main downstream mass flow rate sensor arranged in the pneumatic conveying line at the downstream location upstream of the static distribution device. This downstream control system controls the mass flow rate in the pneumatic conveying line at the downstream location by controlling the opening of the downstream flow control valve responsive to the instantaneous mass flow rate sensed by the at least one downstream mass flow rate sensor. It will be appreciated that this combination of the faster downstream flow control system with the slower upstream flow control system allows to efficiently reduce fluctuations in the mass flow rate observed with a pneumatic conveying line of several hundreds meters that is interconnecting the conveying hopper at the upstream location and the distribution device at a downstream location.

In a very simple embodiment, the downstream flow control system includes a main downstream flow control valve arranged in the pneumatic conveying line at the downstream location upstream of the static distribution device. This downstream control system is capable of controlling the mass flow rate in the pneumatic conveying line at the downstream location by controlling the opening of the main downstream flow control valve responsive to the instantaneous mass flow rate sensed by the main downstream mass flow rate sensor.

In another embodiment, the downstream flow control system includes in each of the injection lines an injection flow control valve. This downstream control system is capable of controlling the mass flow rate in the pneumatic conveying line at the downstream location by controlling the opening of all of the injection flow control valves responsive to the instantaneous mass flow rate sensed by the main downstream mass flow rate sensor. It allows to adjust the mass flow rates in the injection lines more independently from one another.

In yet another embodiment, the downstream flow control system includes in each of the injection lines an injection flow control valve and an injection mass flow rate sensor. This downstream control system is capable of controlling the mass flow rate in the pneumatic conveying line at the downstream location by controlling the opening of all of the injection flow control valves responsive to the instantaneous mass flow rate sensed by the main downstream mass flow rate sensor and by the instantaneous mass flow rates sensed by the injection mass flow rate sensors. It allows to better control distribution of the mass flow rate between the injection lines.

The downstream flow control system may further comprise: in each of the injection lines an injection flow control valve and an injection mass flow rate sensor mounted in series; a first flow controller receiving an output signal of the main downstream mass flow rate sensor as process signal, the first flow controller generating a first control signal for each of the injection flow control valves; a second flow controller receiving an output signal of the injection mass flow rate sensor as process signal, the second flow controller generating a second control signal; and means for combining the first control signal with the second control signal to generate a control signal for the injection flow control valve mounted in series with the latter.

In a preferred embodiment, the upstream control circuit and the downstream control circuit both comprise a limiting circuit capable of limiting the opening range of the upstream flow control valve and the at least one downstream flow control valve independently of one another.

The upstream mass flow rate determination means generally comprises: a calibrated differential weighing system equipping the conveying hopper; and a mass flow rate computing device computing an absolute mass flow rate value on the basis of a weight difference measured by the calibrated differential weighing system during a measuring interval. It will be appreciated that this mass flow rate determination means provides a highly reliable absolute mass flow rate.

A preferred embodiment of the upstream mass flow rate determination means further comprises: a relative mass flow rate sensor including a flow density and a flow velocity sensor, the flow density sensor being capable of sensing solid material concentration in a section of the pneumatic conveying line at the upstream location and the velocity sensor being capable of measuring transport velocity in a section of the pneumatic conveying line at the upstream location, wherein the product of both values is a relative value of the instantaneous mass flow rate in the section. A circuit means then combines the relative mass flow rate value sensed by the relative mass flow rate sensor with the absolute mass flow rate value computed by the mass flow rate computing device, so as to produce an absolute mass flow rate value, based on differential weighing, with superimposed instantaneous mass flow rate fluctuations sensed by the relative mass flow rate sensor.

A preferred embodiment of the main mass flow rate sensor of the downstream control system comprises a relative mass flow rate sensor. This relative mass flow rate sensor advantageously includes a flow density and flow velocity sensor, wherein the flow density sensor is capable of sensing solid material concentration in a section of the pneumatic conveying line at the downstream location and the velocity sensor is capable of measuring transport velocity in a section of the pneumatic conveying line at the downstream location, the product of both values being a relative value of the instantaneous mass flow rate in the section.

The upstream mass flow rate determination means advantageously comprises a calibrated differential weighing system equipping the conveying hopper and a mass flow rate computing device computing an absolute mass flow rate value on the basis of a weight difference measured by the calibrated differential weighing system during a measuring interval. A circuit means then combines the relative value sensed by the relative mass flow rate sensor with the absolute mass flow rate value computed by the mass flow rate computing device, so as to produce an absolute mass flow rate value with superimposed instantaneous fluctuations sensed by the relative mass flow rate sensor.

Such an injection system is advantageously used for injecting pulverized coal or other pulverized or granulated material with a high carbon (such as e.g.: waste material) content into a blast furnace.

BRIEF DESCRIPTION OF THE DRAWINGS

Further features and attendant advantages of the present invention will be apparent from the following detailed description of several not limiting embodiments with reference to the attached drawings, wherein.

In these figures, like reference numbers designate the same or equivalent parts.

DETAILED DESCRIPTION

Preferred embodiments of the present invention are now described in greater detail with reference to a pulverized coal injection system as it is e.g. used for injecting pulverized coal into the tuyeres of a blast furnace.

Figure 1:
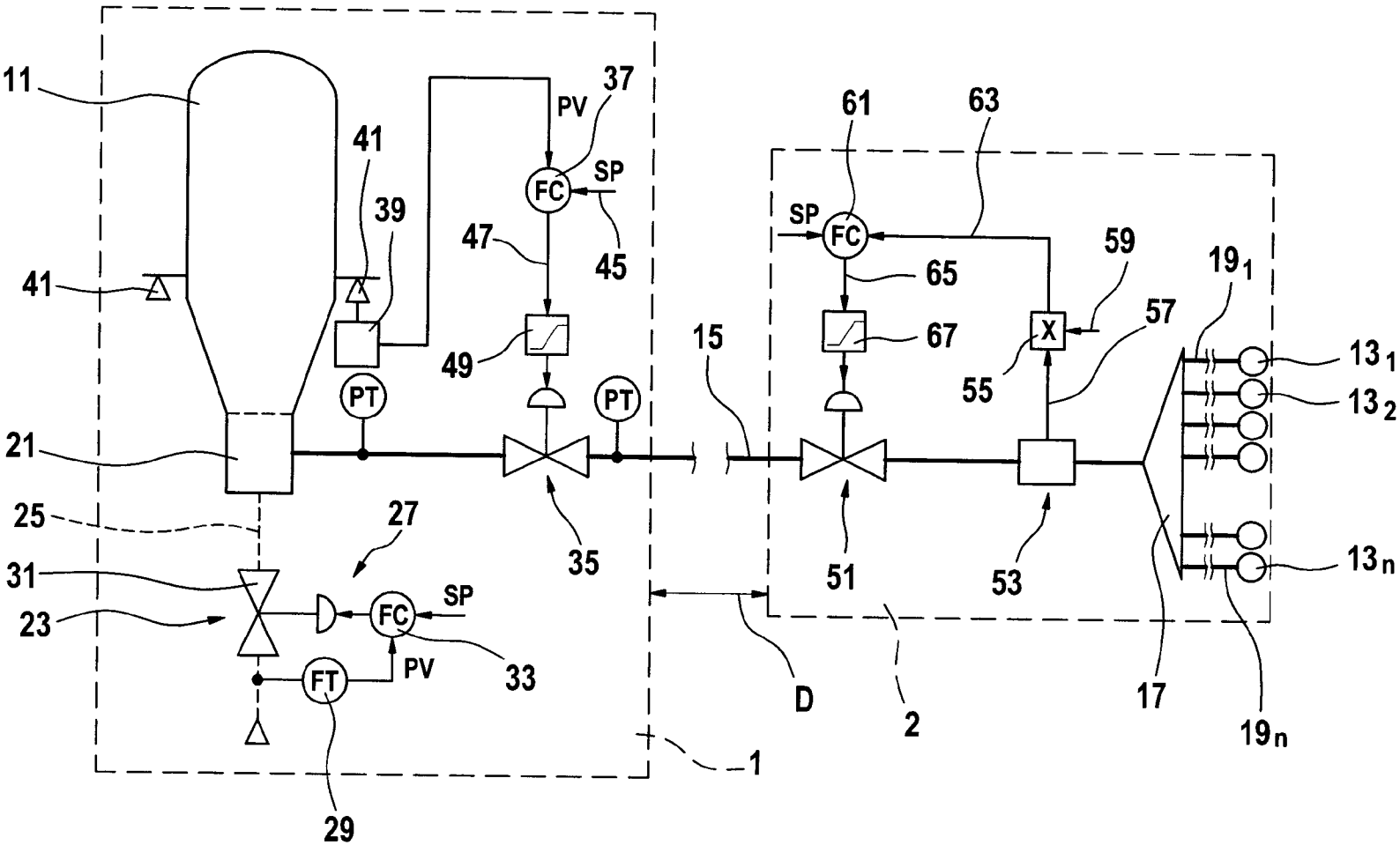
FIG. 1 is schematic diagram of a an injection system for pulverized coal showing a first embodiment of a control system.
Figure 2:
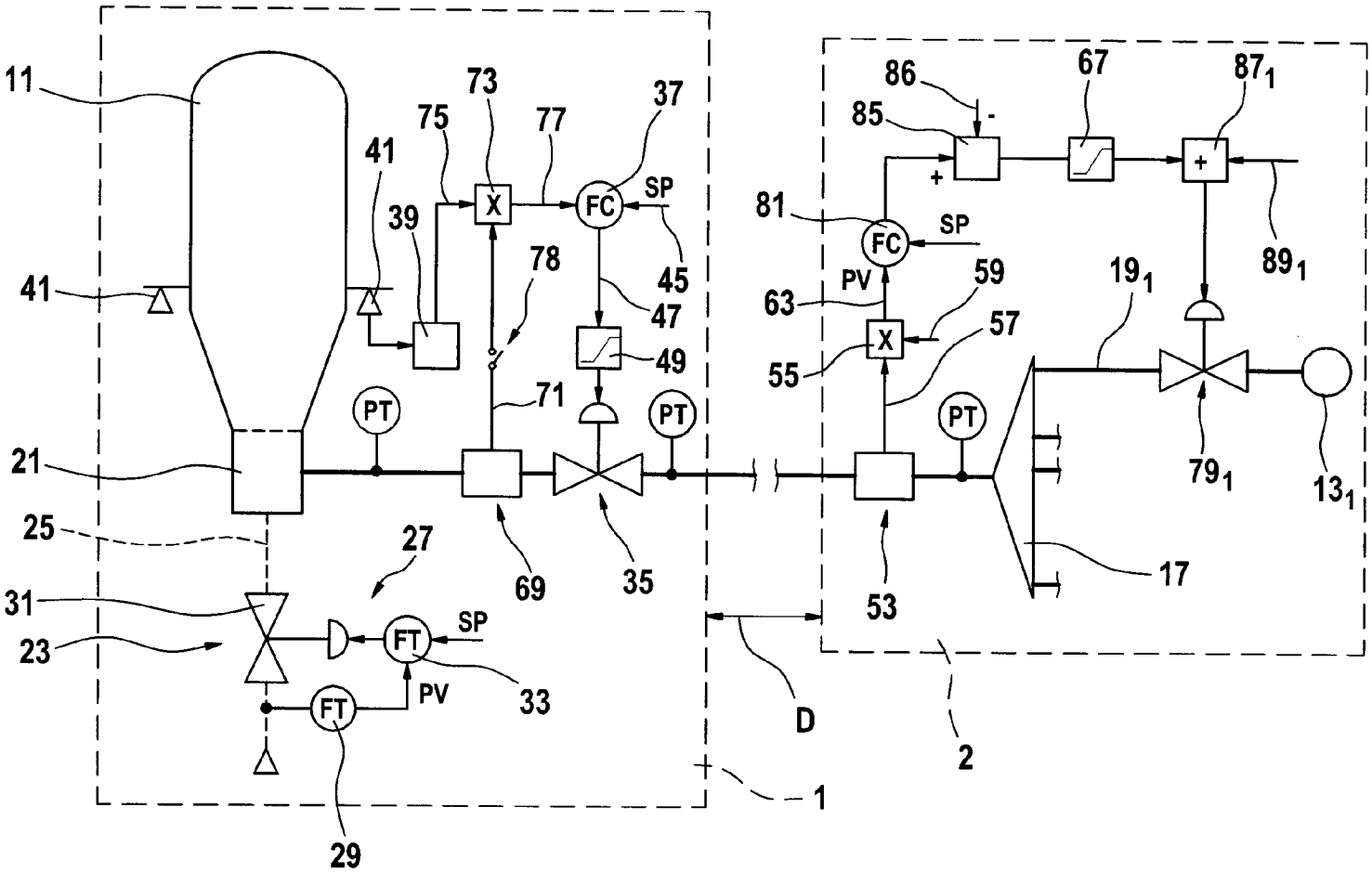
FIG. 2 is schematic diagram of a an injection system for pulverized coal showing a second embodiment of a control system.
Figure 3:
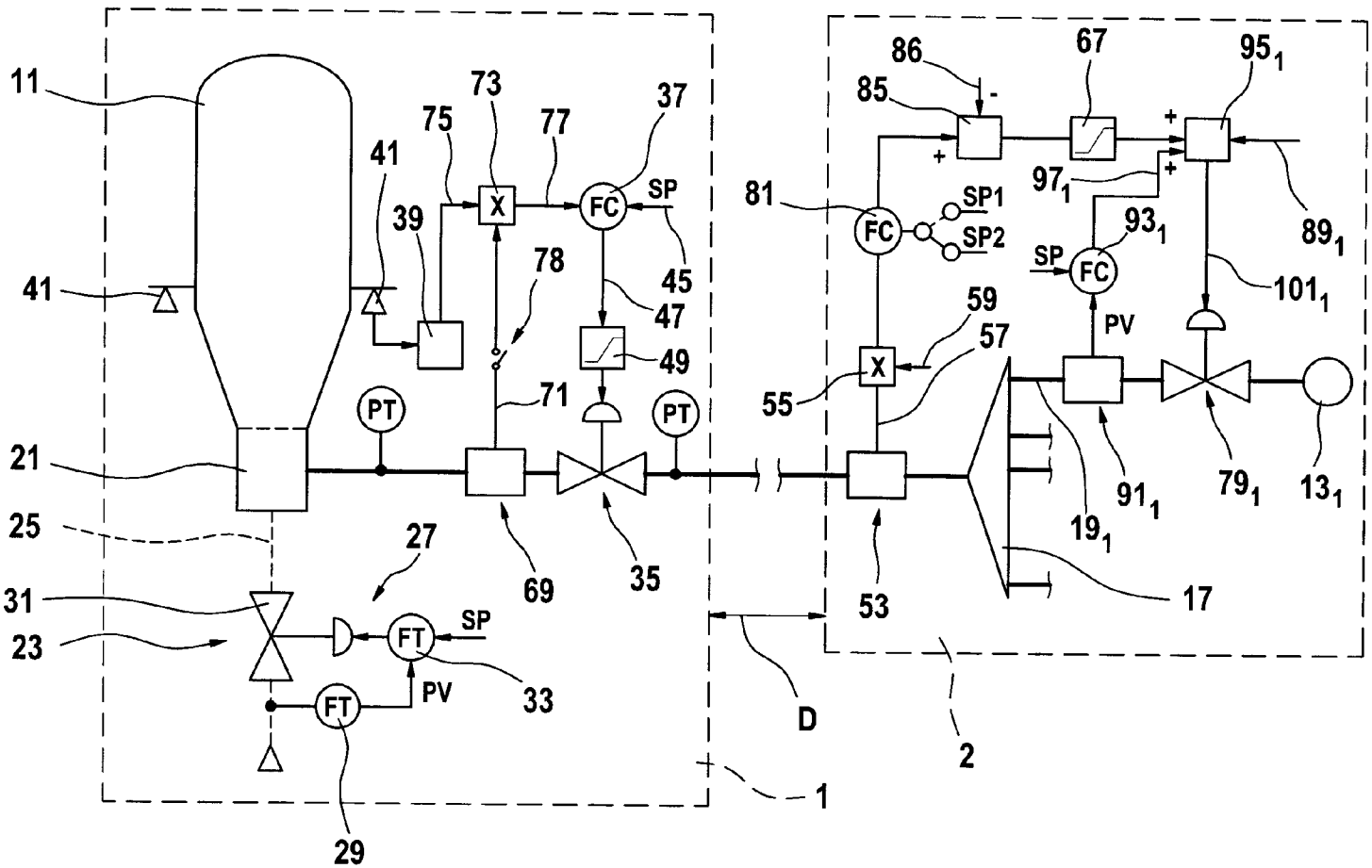
FIG. 3 is schematic diagram of a an injection system for pulverized coal showing a third embodiment of a control system.

In FIG. 1, FIG. 2 and FIG. 3, frame 1 schematically delimits an upstream location, where pulverized coal is stored in a conveying hopper 11. This upstream location is generally in proximity of a pulverized coal preparation plant. Frame 2 schematically delimits a downstream location in proximity of a blast furnace, where pulverized coal is injected by coal injection lances, which are schematically represented by symbols $\mathbf{13}_1 \ldots \mathbf{13}_n$, into the tuyeres of the blast furnace. Both locations are separated by a distance D, which generally equals several hundred meters and may even exceed 1000 m. All elements shown within frame 1 are located at the upstream location. All elements shown within frame 2 are located at the downstream location.

A pneumatic conveying line 15 is used to transport the pulverized coal over this over the distance D from the upstream location to the downstream location. At the downstream location (see frame 2), the pneumatic conveying line 15 is equipped with a static distribution device 17. The latter splits the pneumatic flow between several injection lines $\mathbf{19}_1$-$\mathbf{19}_n$, which supply the coal injection lances $\mathbf{13}_1 \ldots \mathbf{13}_n$ with pulverized coal.

At the upstream location (see frame 1), the pneumatic conveying line 15 is connected to a fluidizing device 21 for fluidizing the pulverized coal at the outlet of the conveying hopper 11. A fluidizing gas supply system 23 injects a fluidizing gas (also called carrier gas), as e.g. nitrogen ($N_2$), through a gas supply line 25 into the fluidizing device 21, so as to fluidize the pulverized coal at the outlet of the conveying hopper 11 and to form a so-called solid-gas flow, which is capable of flowing through the pneumatic conveying line 15.

Fluidization of the pulverized coal in the fluidizing device 21 is controlled in a closed gas control loop 27. This gas control loop 27 includes a gas flow meter 29, which measures the flow rate of the fluidizing gas in the gas supply line 25, a gas flow control valve 31, which is capable of throttling gas flow in the gas supply line 25, and gas flow controller 33, which controls the opening of the gas flow control valve 31, receiving the gas flow rate measured by the gas flow meter 29 as a feed back signal. SP is a set point for the gas flow controller 33. This set point SP may e.g. be computed by a process computer in function of the desired or measured mass flow rate of pulverized coal in the pneumatic conveying line 15 and/or in function of other parameters.

In accordance with the present invention, the injection system further comprises an upstream flow control system for controlling mass flow of pulverized coal in the pneumatic conveying line 15 at the upstream location (frame 1) and a downstream flow control system for controlling mass flow of pulverized coal in the pneumatic conveying line 15 at the downstream location (frame 2). Several embodiments of this upstream and downstream flow control systems will now be described in greater detail with reference to FIG. 1, FIG. 2 and FIG. 3.

The upstream control system shown in frame 1 of FIG. 1 comprises an upstream flow control valve 35 in the pneumatic conveying line 15. A suitable flow control valve 35 is e.g. applicant's flow control valve marketed under the trade name GRITZKO®. This upstream flow control valve 35 is controlled by a first PID flow controller 37, which receives as process signal PV an output signal from a mass flow rate computing device 39. The latter indirectly computes an absolute value for the mass flow rate of pulverized coal in the pneumatic conveying line 15 on the basis of a weight difference measured by a calibrated differential weighing system 41 of the conveying hopper 11, wherein it divides the measured weight difference by the duration of the measuring interval. Thus, there is provided a mass flow rate value in kg/s, which represents a mean value of the mass flow rate during the measuring interval. The resulting upstream mass flow rate value is entered as the process signal PV into the first flow controller 37, which compares it to an adjustable set-point 45 (value in kg/s) and provides a basic control signal 47 for the upstream flow control valve 35. In a limiting circuit 49 this basic control signal 47 is limited as regards its minimum and maximum values, so as to be capable of presetting an opening range (minimum opening-maximum opening) for the upstream flow control valve 35 in normal operation.

The downstream control system shown in frame 2 of FIG. 1 comprises a downstream flow control valve 51 and a mass flow rate sensor 53 (also called hereinafter "mass flow rate sensor 53"). The output signal of this sensor 53 is mainly indicative of changes in the instantaneous mass flow rate in a section of the pneumatic conveying line 15 at the downstream location. A suitable relative mass flow rate sensor 53 is e.g. a capacitive flow rate sensor sold by F. BLOCK, D-52159 ROETGEN (Germany) under the trade name CABLOC. The latter is a combination of a capacitive flow density sensor and a capacitive-correlative velocity sensor. It measures concentration and transport velocity of pulverized coal in a measuring section, wherein the product of both values is a relative value of the mass flow rate.

In a multiplier circuit 55, the relative mass flow rate output signal 57 of the sensor 53 is combined with a correction factor 59 from the upstream mass flow rate computing device 39 (i.e. an identical or processed copy of signal 75) to form for a second PID controller 61 a corrected process signal 63. This corrected process signal 63 is representative of the upstream mass flow rate in the pneumatic conveying line 15 just upstream of the distribution device 17. The controller 61 receives as set-point a copy of the set-point 45 of flow controller 37 in frame 1 (or a post-treated copy thereof) and provides a basic control signal 65 for flow control valve 51. In a limiting circuit 67 this basic control signal 65 is limited as regards its minimum and maximum values, so as to be capable of presetting an opening range for the downstream flow control valve 51 in normal operation.

Figure 4:
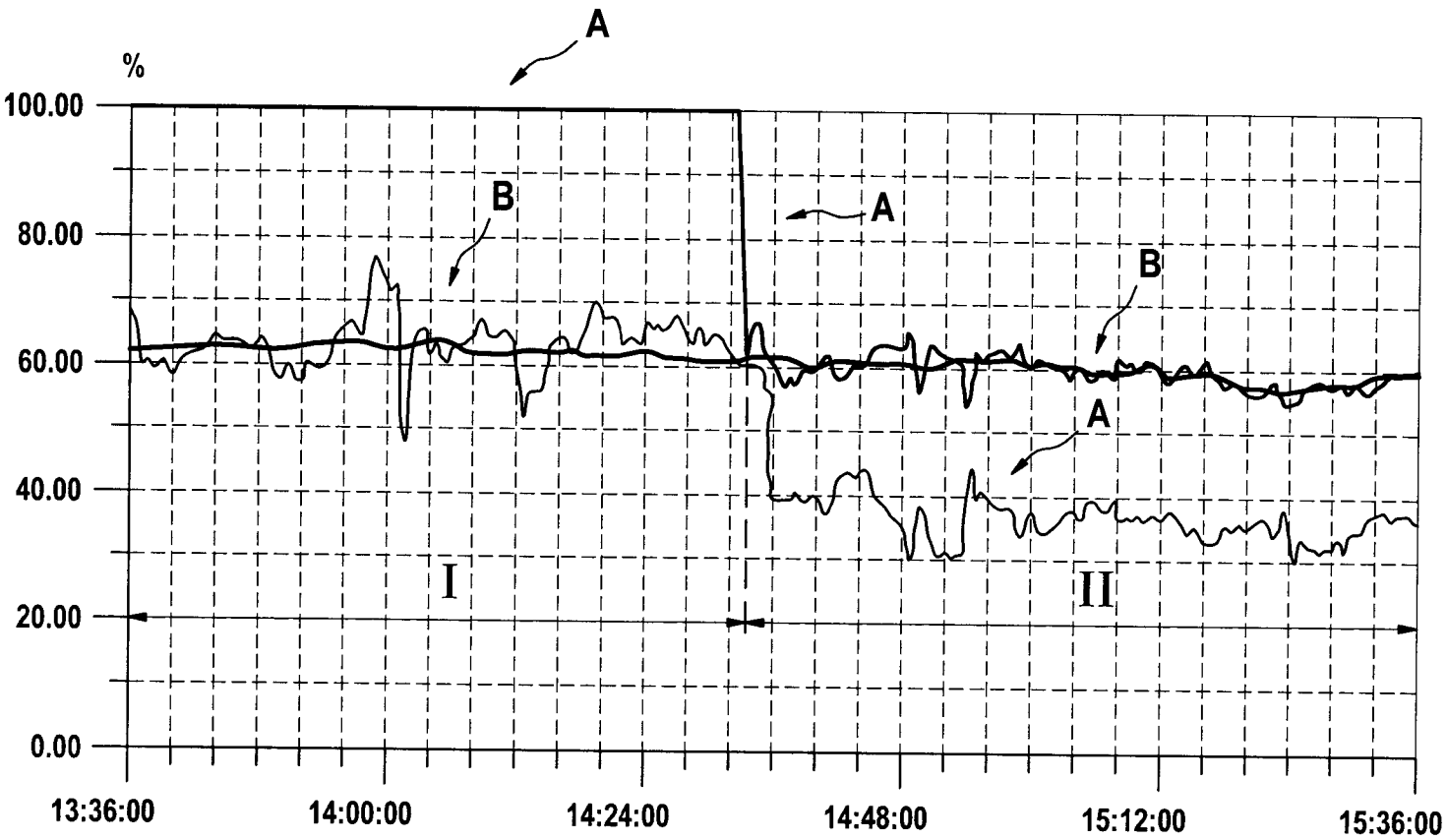
FIG. 4 is a diagram illustrating how the present invention reduces fluctuations in mass flow.

A pulverized coal injection system as shown in FIG. 1 has been tested in real operation in a test plant. The distance between the upstream location and the downstream location in the test plant has been about 500 m. FIG. 4 shows the test results that have been obtained. The total duration of the test represented in FIG. 4 is 2 hours. This test is subdivided in a phase I and a phase II (see arrows), each phase having a duration of 1 hour. During phase I (i.e. during the first hour of the test), the upstream flow control valve 35 controls mass flow rate in the pneumatic conveying line 15 at the upstream location as described hereinbefore, whereas the downstream flow control valve 51 is maintained entirely open (opening 100%). During phase II (i.e. during the second hour of the test), the upstream flow control valve 35 continues to control mass flow rate in the pneumatic conveying line 15 at the upstream location as described hereinbefore, and the downstream flow control valve 51 controls mass flow rate in the pneumatic conveying line 15 at the downstream location as described hereinbefore. Curve A in FIG. 4 represents the relative opening of the downstream flow control valve 51 in percent. Curve B represents the mass flow rate measured by sensor 53 at the downstream location. It will be appreciated that the amplitudes of the flow rate fluctuations measured by sensor 53 (see curve B) during test phase II are much lower than those measured during test phase I.

To reduce the risk of the system becoming instable, it is recommended to chose for the upstream flow control valve 35 a smaller working range than for the downstream flow control valve 51. Both working ranges can be easily adjusted by means of the limiting circuits 49, 67. During the aforementioned test, the working ranges of the first and downstream flow control valve 35 and 51 were e.g. set as follows:

| | Flow control valve 35 | Flow control valve 51 |
|---|---|---|
| Minimum opening | 50% | 25% |
| Maximum opening | 60% | 50% |

Furthermore, during the test following tuning parameters were used for PID flow controller 37 at the upstream location and PID flow controller 61 at the downstream location:

| | Flow controller 37 | Flow controller 61 |
|---|---|---|
| Kp (proportional gain) | 0.007 | 0.015 |
| Ti (Integral Time) | 80 | 60 |

It remains to be noted that it is recommended to put out of service the flow rate control circuit at the downstream location (second PID flow controller 61) during start up of the pulverized coal injection system, i.e. to maintain a constant opening for flow control valve 51. Furthermore, when starting the flow rate control circuit at the downstream location (second PID flow controller 61), it is highly recommended to preset for the flow control valve 51 an opening within the working range specified above. As can be seen in FIG. 4, an opening of e.g. 40% was preset for flow control valve 51 during the test of FIG. 4.

The control system shown in frame 1 of FIG. 2 differs from the system shown in frame 1 of FIG. 1 mainly in that a sensor 69 provides a relative mass flow rate value 71. A suitable sensor for this purpose is e.g. the above-mentioned CABLOC sensor from F. BLOCK, D-52159 ROETGEN (Germany). A multiplier circuit 73 combines the relative mass flow rate value 71 of the sensor 69 with an output signal 75 of the upstream mass flow rate computing device 39 to produce a corrected process signal 77, which is used as an input signal for controller 37. This corrected process signal 77 represents the upstream mass flow rate in the conveying line 15. It is more responsive to quick fluctuations in the mass flow rate than the non-corrected process signal of the upstream mass flow rate computing device in FIG. 1, whereby it contributes to achieving a more uniform flow rate in the pneumatic conveying line 15. A switch 78 allows to deactivate the sensor 69 in the control system shown in frame 1 of FIG. 2, so that the latter functions in the same way as the control system shown in frame 1 of FIG. 1. For stability reasons it is indeed preferable to start the injection system without taking into account the signal of sensor 69.

The control system shown in frame 2 of FIG. 2 differs from the system shown in frame 2 of FIG. 1 mainly in that the main flow control valve 51 upstream of the static distribution device 17 is replaced by an injection flow control valve $\mathbf{79}_1 \ldots \mathbf{79}_n$ in each injection line $\mathbf{19}_1$-$\mathbf{19}_n$. The main mass flow rate sensor and the multiplier circuit 55 are of the same type and function in the same way as in FIG. 1. The PID flow controller 81 provides a basic control signal for each of the injection flow control valves $\mathbf{79}_1 \ldots \mathbf{79}_n$ controlling the mass flow rate in the pneumatic conveying line 15 at the downstream location by controlling the opening of all of the injection flow control valves $\mathbf{79}_1 \ldots \mathbf{79}_n$ responsive to the instantaneous mass flow rate sensed by said main downstream main mass flow rate sensor 53. In a correction circuit 85, a correction signal 86 may be subtracted from the basic control signal produced by flow controller 81. This correction signal 86 may e.g. be the raw or post-treated output signal 47 of the upstream flow controller 37. An adjusting circuit 87, associated with each of the injection flow control valves $\mathbf{79}_1 \ldots \mathbf{79}_n$ adds a constant value signal 89, to the output of limiting circuit 67. Thereby it becomes possible to individually adjust the start position of each injection flow control valve $\mathbf{79}_i$.

The control system shown in frame 1 of FIG. 3 is identical to the system shown in frame 1 of FIG. 2.

The control system shown in frame 2 of FIG. 3 differs from the system shown in frame 2 of FIG. 2 mainly in that it comprises an injection mass flow rate sensor 91, in each of the injection lines $\mathbf{19}_i$, this in addition to the main mass flow rate sensor 53 located upstream of the static distribution device 17. Each of these injection mass flow rate sensors $\mathbf{91}_i$ is associated with a PID flow controller $\mathbf{93}_i$, which receives the output signal of injection mass flow rate sensor $\mathbf{91}_i$ as a process signal PV. In an adding circuit $\mathbf{95}_i$, the output signal $\mathbf{97}_i$ of the flow controller $\mathbf{93}_i$ is combined with the post-treated output signal of the flow controller 81 to form a control signal $\mathbf{101}_i$ for the injection flow control valve $\mathbf{79}_i$. This applies to each of the n injection lines $\mathbf{19}_1 \ldots \mathbf{19}_2$. It will be appreciated that this system allows to further improve equi-distribution of mass flow rates in the injection lines $\mathbf{19}_i$.

In conclusion, the control systems shown in FIG. 1-FIG. 3 allow to reduce mass flow rate fluctuations in the pneumatic conveying line 15. By eliminating to a large extent unpredictable fluctuations, the control systems described herein provide the basis for precise adjustment and metering of pulverized coal injection. Certain embodiments also contribute to a better equi-distribution of mass flow rates in the injection lines $\mathbf{16}_i$. As will be appreciated, the above control systems and their different combinations optimize the pulverized coal injection process thereby enabling improved blast furnace operation.

The invention claimed is:

1. An injection system for solid particles, said injection system being configured for conveying a solid-gas flow including solid particles from an upstream location to a downstream location, said injection system comprising:

a conveying hopper located at said upstream location;

a fluidizing device for fluidizing the solid particles at the outlet of said conveying hopper and forming said solid-gas flow;

a pneumatic conveying line for conveying said solid-gas flow from said fluidizing device to a downstream location, said pneumatic conveying line including at said downstream location a static distribution device with a plurality of injection lines connected thereto;

an upstream flow control system including:

an upstream flow control valve arranged in said pneumatic conveying line at said upstream location; and an upstream mass flow rate determination device capable of measuring an instantaneous solid material mass flow in said pneumatic conveying line at said upstream location;

said upstream control system being capable of controlling the mass flow rate in said pneumatic conveying line at said upstream location by controlling the opening of said upstream flow control valve responsive to a solid material mass flow measured in said pneumatic conveying line at said upstream location;

a downstream flow control system including:

at least one downstream flow control valve arranged in said pneumatic conveying line at said downstream location upstream of said static distribution device; and a main downstream mass flow rate sensor arranged in said pneumatic conveying line at said downstream location upstream of said static distribution device and capable of measuring a downstream instantaneous mass flow rate, said downstream control system being capable of controlling the mass flow rate in said pneumatic conveying line at said downstream location by controlling the opening of said at least one downstream flow control valve responsive to said instantaneous mass flow rate sensed by said main downstream mass flow rate sensor.

2. The injection system as claimed in claim 1, wherein: said downstream flow control system includes in each of said injection lines an injection flow control valve, said downstream control system being capable of controlling the mass flow rate in said pneumatic conveying line at said downstream location by controlling the opening of all of said injection flow control valves responsive to said instantaneous mass flow rate sensed by said main downstream mass flow rate sensor.

3. The injection system as claimed in claim 2, wherein: said downstream flow control system includes a main downstream flow control valve arranged in said pneumatic conveying line at said downstream location upstream of said static distribution device, said downstream control system being capable of controlling the mass flow rate in said pneumatic conveying line at said downstream location by controlling the opening of said main downstream flow control valve responsive to said instantaneous mass flow rate sensed by said main downstream mass flow rate sensor.

4. The injection system as claimed in claim 1, wherein: said downstream flow control system includes in each of said injection lines an injection flow control valve and an injection mass flow rate sensor, said downstream control system being capable of controlling the mass flow rate in said pneumatic conveying line at said downstream location by controlling the opening of all of said injection flow control valves responsive to said instantaneous mass flow rate sensed by said main downstream mass flow rate sensor and by said instantaneous mass flow rates sensed by said injection mass flow rate sensors.

5. The injection system as claimed in claim 4, wherein: said downstream flow control system includes a main downstream flow control valve arranged in said pneumatic conveying line at said downstream location upstream of said static distribution device, said downstream control system being capable of controlling the mass flow rate in said pneumatic conveying line at said downstream location by controlling the opening of said main downstream flow control valve responsive to said instantaneous mass flow rate sensed by said main downstream mass flow rate sensor.

6. The injection system as claimed in claim 1, wherein said downstream flow control system further comprises:

in each of said injection lines an injection flow control valve and an injection mass flow rate sensor mounted in series;

a first flow controller receiving an output signal of said main downstream mass flow rate sensor as process signal, said first flow controller generating a first control signal for each of said injection flow control valves;

a second flow controller receiving an output signal of said injection mass flow rate sensor as process signal, said second flow controller generating a second control signal; and a device for combining said first control signal with said second control signal to generate a control signal for said injection flow control valve mounted in series with the latter.

7. The injection system as claimed in claim 6, wherein: said downstream flow control system includes a main downstream flow control valve arranged in said pneumatic conveying line at said downstream location upstream of said static distribution device, said downstream control system being capable of controlling the mass flow rate in said pneumatic conveying line at said downstream location by controlling the opening of said main downstream flow control valve responsive to said instantaneous mass flow rate sensed by said main downstream mass flow rate sensor.

8. The injection system as claimed in claim 1, wherein said upstream control circuit and said downstream control circuit both comprise a limiting circuit capable of limiting the opening range of said upstream flow control valve and said at least one downstream flow control valve independently of one another.

9. The injection system as claimed in claim 1, wherein said upstream mass flow rate determination device comprises:

a calibrated differential weighing system equipping said conveying hopper; and a mass flow rate computing device for computing an absolute mass flow rate value on the basis of a weight difference measured by said calibrated differential weighing system during a measuring interval.

10. The injection system as claimed in claim 9, wherein said upstream mass flow rate determination device further comprises:

a relative mass flow rate sensor including a flow density and a flow velocity sensor, said flow density sensor being capable of sensing solid material concentration in a section of said pneumatic conveying line at said upstream location and said velocity sensor being capable of measuring transport velocity in a section of said pneumatic conveying line at said upstream location, wherein the product of both values is a relative value of the instantaneous mass flow rate in said section; and a circuit for combining said relative mass flow rate value sensed by said relative mass flow rate sensor with said absolute mass flow rate value computed by said mass flow rate computing device, so as to produce an absolute mass flow rate value with superimposed instantaneous fluctuations sensed by said relative mass flow rate sensor.

11. The injection system as claimed in claim 1, wherein said main mass flow rate sensor of said downstream control system comprises a relative mass flow rate sensor.

12. The injection system as claimed in claim 11, wherein: said relative mass flow rate sensor includes a flow density and flow velocity sensor, said flow density sensor being capable of sensing solid material concentration in a section of said pneumatic conveying line at said downstream location and said velocity sensor being capable of measuring transport velocity in a section of said pneumatic conveying line at said downstream location, the product of both values being a relative value of the instantaneous mass flow rate in said section.

13. The injection system as claimed in claim 12, wherein: said upstream mass flow rate determination device comprises a calibrated differential weighing system equipping said conveying hopper and a mass flow rate computing device for computing an absolute mass flow rate value on the basis of a weight difference measured by said calibrated differential weighing system during a measuring interval; and said downstream control system comprises a circuit for combining said relative value sensed by said relative mass flow rate sensor with said absolute mass flow rate value computed by said mass flow rate computing device, so as to produce an absolute mass flow rate value with superimposed instantaneous fluctuations sensed by said relative mass flow rate sensor.

14. Blast furnace comprising an injection system as claimed in claim 1, said injection system being configured for injecting pulverized coal or other pulverized or granulated material that has high carbon content into said blast furnace.

15. A system for conveying a solid-gas flow containing fluidized solid particles from an upstream location to a downstream location, said injection system comprising:

a conveying hopper located at said upstream location for storing solid particles;

a fluidizing device arranged at the outlet of said conveying hopper for fluidizing said solid particles so as to form a solid-gas flow;

a pneumatic conveying line for conveying said solid-gas flow from said fluidizing device to said downstream location, said pneumatic conveying line including a distribution device arranged at said downstream location, said distribution device having a plurality of injection lines connected thereto;

an upstream flow control system comprising:

an upstream flow control valve arranged in said pneumatic conveying line at said upstream location; and an upstream mass flow rate determination device capable of measuring a solid material mass flow through said pneumatic conveying line at said upstream location;

said upstream control system being capable of controlling the mass flow rate through said pneumatic conveying line at said upstream location by controlling said upstream flow control valve based on solid material mass flow measured in said pneumatic conveying line at said upstream location;

a downstream flow control system comprising:

at least one downstream flow control valve arranged in said pneumatic conveying line at said downstream location and upstream of said static distribution device; and a main downstream mass flow rate sensor capable of measuring a downstream instantaneous mass flow rate through said pneumatic conveying line at said downstream location and upstream of said static distribution device, said downstream control system being capable of controlling the mass flow rate through said pneumatic conveying line at said downstream location by controlling said at least one downstream flow control valve based on instantaneous mass flow rate sensed by said main downstream mass flow rate sensor.

16. Blast furnace comprising a system as claimed in claim 15 for conveying metered quantities of pulverized coal to a plurality of tuyeres on said blast furnace, each tuyere having an injection lance connected to one of said injection lines respectively.

* * * * *